US011913325B2

(12) United States Patent
Das et al.

(10) Patent No.: US 11,913,325 B2
(45) Date of Patent: Feb. 27, 2024

(54) UNITIZED DOWNHOLE TOOL SEGMENT

(71) Applicant: HALLIBURTON ENERGY SERVICES, INC., Houston, TX (US)

(72) Inventors: Pralay Kumar Das, Sugar Land, TX (US); Michael Dewayne Finke, Cypress, TX (US); Brian David Breaux, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/663,197

(22) Filed: Oct. 24, 2019

(65) Prior Publication Data

US 2020/0370415 A1 Nov. 26, 2020

Related U.S. Application Data

(63) Continuation of application No. PCT/US2019/057907, filed on Oct. 24, 2019.

(Continued)

(51) Int. Cl.
*E21B 47/017* (2012.01)
*E21B 17/042* (2006.01)

(52) U.S. Cl.
CPC ..... *E21B 47/017* (2020.05); *E21B 17/042* (2013.01)

(58) Field of Classification Search
CPC ..... E21B 47/017; E21B 17/042
See application file for complete search history.

(56) References Cited

U.S. PATENT DOCUMENTS 2,245,712 A * 6/1941 Ragan ..... E21B 33/12 166/66.4
3,469,629 A * 9/1969 Adamache ..... E21B 33/128 277/342

(Continued)

FOREIGN PATENT DOCUMENTS

| | | |
|---|---|---|
| CN | 201851102 U | 6/2011 |
| WO | 2003002840 A2 | 1/2003 |
| WO | 2005072354 A1 | 8/2005 |

OTHER PUBLICATIONS

English abstract of CN201851102; retreived from www.espacenet.com on Oct. 24, 2019.

(Continued)

*Primary Examiner* — Tara Schimpf
*Assistant Examiner* — Neel Girish Patel
(74) *Attorney, Agent, or Firm* — NOVAK DRUCE CARROLL LLP

(57) ABSTRACT

According to various aspects of the subject technology, a tool collar is provided. The tool collar may include a recessed portion comprising a component segment and a threaded segment, a pressure sleeve covering the recessed portion, and a threaded component mated to the threaded segment and configured to compress the pressure sleeve against a shoulder of a downhole tool. According to some aspects, a downhole tool is provided. The downhole tool may include a recessed portion comprising a component segment and a threaded segment, an unrecessed portion comprising a shoulder, a pressure sleeve covering the recessed portion of the downhole tool, and a threaded component mated to the threaded segment and configured to compress the pressure sleeve against the shoulder of the unrecessed portion.

16 Claims, 9 Drawing Sheets

Related U.S. Application Data

(60) Provisional application No. 62/850,299, filed on May 20, 2019.

(56) References Cited

U.S. PATENT DOCUMENTS 4,294,318 A * 10/1981 Desbrandes ..... E21B 47/007 73/152.59
4,779,852 A * 10/1988 Wassell ..... F16F 1/32 267/141.1
5,563,512 A 10/1996 Mumby
6,666,285 B2 * 12/2003 Jones ..... E21B 47/01 175/325.1
6,927,390 B2 * 8/2005 Mickael ..... G01V 5/125 250/254
6,932,154 B2 8/2005 Zillinger
7,980,331 B2 7/2011 Hall et al.
9,435,193 B2 9/2016 Chau et al.
10,006,280 B2 * 6/2018 Logan ..... E21B 47/017
2002/0066561 A1 * 6/2002 Brockman ..... E21B 43/08 166/250.15
2005/0279513 A1 * 12/2005 Eppink ..... E21B 17/10 166/380
2007/0125554 A1 * 6/2007 Reid ..... E21B 34/108 166/123
2008/0202742 A1 8/2008 Hall et al.
2008/0211687 A1 * 9/2008 Price ..... E21B 47/14 340/854.3
2009/0179648 A1 * 7/2009 Fredette ..... G01V 3/30 324/342
2010/0186944 A1 * 7/2010 Hall ..... E21B 41/0085 166/65.1
2012/0273233 A1 * 11/2012 Drenth ..... E21B 17/042 175/325.1
2013/0076025 A1 * 3/2013 Gipson ..... E21B 17/041 137/15.01
2013/0105222 A1 * 5/2013 Pate ..... E21B 17/1014 175/40
2013/0277114 A1 * 10/2013 Hook ..... E21B 47/017 175/50
2015/0300098 A1 * 10/2015 Logan ..... E21B 17/105 166/237
2016/0268041 A1 * 9/2016 Deville ..... E21B 17/0283
2017/0009563 A1 * 1/2017 Holder ..... E21B 43/263
2018/0058201 A1 * 3/2018 Zheng ..... E21B 47/017
2018/0238119 A1 * 8/2018 Park ..... E21B 4/02
2019/0145245 A1 * 5/2019 Treviranus ..... E21B 47/017 166/380

OTHER PUBLICATIONS

International Search Report and Written Opinion for International application No. PCT/US2019/057907, dated Feb. 20, 2020, 9 pages.
Examination Report; Saudi Arabian Application No. 521430628; dated May 30, 2023.

* cited by examiner

UNITIZED DOWNHOLE TOOL SEGMENT

CROSS-REFERENCE TO RELATED APPLICATIONS

This application is a continuation application of PCT Application No. PCT/US2019/057907, filed Oct. 24, 2019, which claims the benefit of priority to U.S. Appl. No. 62/850,299 filed May 20, 2019, entitled "UNITIZED DOWNHOLE TOOL SEGMENT", the entire contents of which is hereby incorporated herein by reference.

TECHNICAL FIELD

The present technology pertains to tools used in a downhole environment, and more particularly, a sleeve portion of a downhole tool.

BACKGROUND

In the exploration and production of hydrocarbons, various downhole tools are frequently lowered into a borehole, such as drilling assemblies, measurement tools, and production devices. The downhole tool is a part of the bottom hole assembly (BHA) used for drilling the subterranean holes for exploration or production. These downhole tools can include a number of different types of components such as electronic equipment, sensors, or other modules used for various purposes. For example, the components may be used for controlling the downhole tools, communicating with a surface location, and storage and analysis of monitored wellbore data. These components may include sensitive parts including, for example, sensors, printed circuit boards (PCBs), and electronics that are mounted to the PCBs. The downhole tool may experience harsh downhole environments including, for example, elevated temperatures and pressures, vibration, thermo-mechanical stresses, and thermal shock. The downhole tool may also experience a number of additional stresses, including torque stresses and bending stresses, as a result of hydrocarbon exploration and production process.

BRIEF DESCRIPTION OF THE DRAWINGS

In order to describe the manner in which the features and advantages of this disclosure can be obtained, a more particular description is provided with reference to specific embodiments thereof which are illustrated in the appended drawings. Understanding that these drawings depict only exemplary embodiments of the disclosure and are not therefore to be considered limiting of its scope, the principles herein are described and explained with additional specificity and detail through the use of the accompanying drawings in which.

DETAILED DESCRIPTION

Figure 1A:
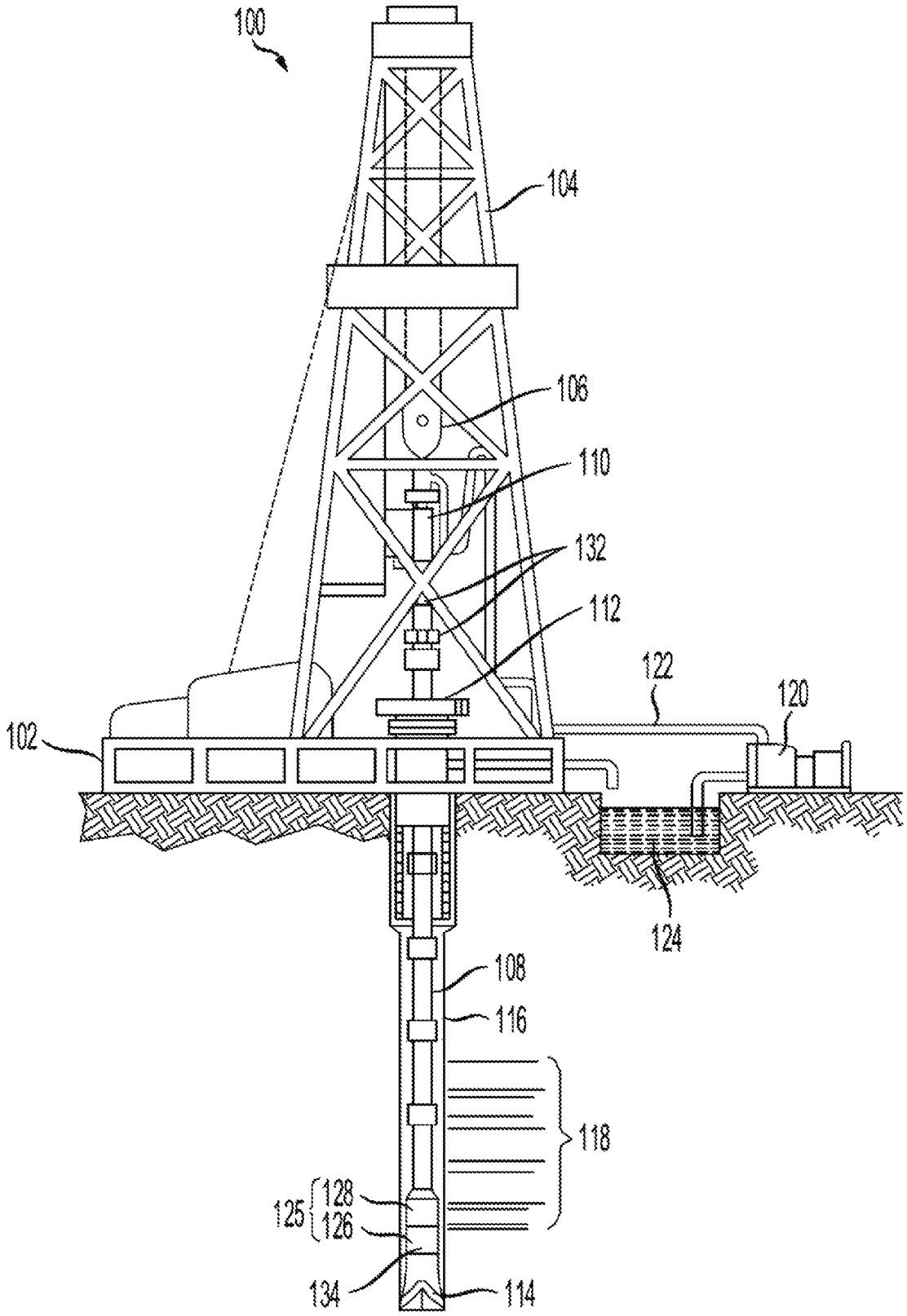
FIG. 1A is a schematic diagram of an example logging while drilling (LWD) wellbore operating environment, in accordance with various aspects of the subject technology.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Various sensors and other electronics may be placed in a downhole tool to generate data that provides information about the downhole environment, the health and/or performance of the downhole tool, and the drilling process. The generated data may be used to plan or alter a drilling strategy, provide insight about the formation and/or reservoir, or otherwise improve hydrocarbon exploration and production processes. Other components may also be included in the downhole tool to aid in the operation of the downhole tool or otherwise improve the performance of any components used in the drilling process. However, these sensors, electronics, and other components take up space in the downhole tool and other methods of placing the components in the downhole tool may reduce the structural integrity of the downhole tool. For example, including the components in the downhole tool may require providing pockets in a tool collar of the downhole tool to hold the components. These pockets reduce the section modulus of the tool collar and, as a result, reduce the strength of the tool collar. The strength of the tool collar and of the rest of the downhole tool is critical in harsh downhole environments.

Several other factors exacerbate these technical obstacles. Often, sensors and other components operate best when they are located near the drill bit. However, space near the drill bit is limited and placing more components near the drill bit means providing more space (e.g., wider pockets) in the tool collar for the components, further reducing the section modulus of the tool collar, and further reducing the structural integrity of the tool collar. There is also a desire to reduce product and shipping costs by reducing the length of a tool collar which results in packaging more components in a smaller space (e.g., a shorter tool collar), which similarly reduces the section modulus and structural integrity of the tool collar.

At the same time, more recent trends require the use of the downhole tools in more extreme environments and more extreme operational requirements for the downhole tools. For example, drilling operations may require increasing the torque and bending capacity of a tool collar and/or downhole tool which suggests increasing the section modulus of the tool collar. These competing requirements necessitated a design that allowed larger pockets and increased section modulus.

Various aspects of the subject technology address these and other technical problems. For example, according to various aspects, a tool collar of a downhole tool is provided with larger (e.g., wider) pockets. However, the section modulus of the tool collar is increased by incorporating a unitized pressure sleeve to offset the loss of material caused by the larger pockets of the tool collar. By loading the pressure sleeve in compression, the pressure sleeve provides added structural support to strengthen the downhole tool body. By loading the pressure sleeve in compression, the pressure sleeve is sealed on each end and prevents external contaminants from damaging the electronic components and sensors housed within the pockets in the tool collar under the sleeve. A secondary sealing means is also provided by a set of seals (e.g., O-rings) disposed at each end of the pressure sleeve. Accordingly, primary and secondary sealing of electronic components is provided by the pressure sleeve, in compression, and about the seals. The unitized pressure sleeve is used to strengthen and increase a section modulus of a tool collar having wide pockets.

Aspects of the subject technology further enable the packaging of more electronics in the tool collar near the sensors, which reduces signal noise. Sensors may also be packaged closer to the formation of interest, which allows for more accurate data capture. The sensors may also be positioned closer to the drill bit, which improves sensor readings and reduces real time measurement delay.

According to at least one aspect, a tool collar is provided. The tool collar may include a recessed portion comprising a component segment and a threaded segment, a pressure sleeve covering the recessed portion, and a threaded component mated to the threaded segment and configured to compress the pressure sleeve with a shoulder of a downhole tool. The tool collar may further include a spacer ring positionable between the threaded component and the pressure sleeve. Alternatively or additionally, the tool collar may include a torque sleeve positionable between the threaded component and the pressure sleeve, the torque sleeve comprising an anti-rotation mechanism configured to prevent rotation of the torque sleeve about the recessed portion.

The threaded segment of the tool collar may be tapered and/or the recessed portion may further include at least one pocket configured to accept a downhole component. The tool collar may also include a set of O-rings positionable on opposite ends of the component segment, wherein the set of O-rings are further positionable between the pressure sleeve and the recessed portion of the downhole tool. According to some embodiments, the pressure sleeve may be designed to seal against downhole pressure without the use of O-rings or any other type of seal. The O-rings provide a secondary seal which is intended to be a failsafe mechanism. In regard to the use of O-rings for a secondary seal, any type of seal can be incorporated. Sealing options are inclusive of but not limited to O-rings, T-seals, any cross section elastomer seals, polytetrafluoroethylene (PTFE) seals, metal seals, or the like.

According to at least one aspect, a downhole tool is provided that includes a segment with a recessed portion comprising a component segment and a threaded segment, an unrecessed portion comprising a shoulder, a pressure sleeve covering the recessed portion of the downhole tool, and a threaded component mated to the threaded segment and configured to compress the pressure sleeve against the shoulder of the unrecessed portion. The downhole tool may further include a spacer ring positionable between the threaded component and the pressure sleeve. Alternatively, the downhole tool may include a torque sleeve positionable between the threaded component and the pressure sleeve, the torque sleeve comprising an anti-rotation mechanism configured to prevent rotation of the torque sleeve about the recessed portion.

The threaded segment of the downhole tool may be tapered and/or the recessed portion may further include at least one pocket configured to accept a downhole component. The downhole tool may also include a set of O-rings positionable on opposite ends of the component segment, wherein the set of O-rings are further positionable between the pressure sleeve and the recessed portion of the downhole tool.

According to at least one aspect, a method is provided. The method may include sliding a pressure sleeve over a recessed portion of a downhole tool, wherein the downhole tool further comprises an unrecessed portion. The method may further include mating a threaded component onto a threaded component of the recessed portion of the downhole tool to compress the pressure sleeve against a shoulder of the unrecessed portion of the downhole tool.

The disclosure now turns to FIG. 1A, which illustrates a schematic view of a logging while drilling (LWD) wellbore operating environment 100 in accordance with some examples of the present disclosure. As depicted in FIG. 1A, a drilling platform 102 can be equipped with a derrick 104 that supports a hoist 106 for raising and lowering a drill string 108. The hoist 106 suspends a top drive 110 suitable for rotating and lowering the drill string 108 through a well head 112. A drill bit 114 can be connected to the lower end of the drill string 108. As the drill bit 114 rotates, the drill bit 114 creates a wellbore 116 that passes through various subterranean formations 118. A pump 120 circulates drilling fluid through a supply pipe 122 to top drive 110, down through the interior of drill string 108 and orifices in drill bit 114, back to the surface via the annulus around drill string 108, and into a retention pit 124. The drilling fluid transports cuttings from the wellbore 116 into the retention pit 124 and aids in maintaining the integrity of the wellbore 116. Various materials can be used for drilling fluid, including oil-based fluids and water-based fluids.

Logging tools 126 can be integrated into the bottom-hole assembly 125 near the drill bit 114. As the drill bit 114 extends the wellbore 116 through the formations 118, logging tools 126 collect measurements relating to various formation properties as well as the orientation of the tool and various other drilling conditions. The bottom-hole assembly 125 may also include a telemetry sub 128 to transfer measurement data to a surface receiver 132 and to receive commands from the surface. In at least some cases, the telemetry sub 128 communicates with a surface receiver 132 using mud pulse telemetry. In some instances, the telemetry sub 128 does not communicate with the surface, but rather stores logging data for later retrieval at the surface when the logging assembly is recovered.

Each of the logging tools 126 may include one or more tool components spaced apart from each other and communicatively coupled with one or more wires and/or other media. The logging tools 126 may also include one or more computing devices 134 communicatively coupled with one or more of the one or more tool components by one or more wires and/or other media. The one or more computing devices 134 may be configured to control or monitor a performance of the tool, process logging data, and/or carry out one or more aspects of the methods and processes of the present disclosure.

In at least some instances, one or more of the logging tools 126 may communicate with a surface receiver 132 by a wire, such as wired drill pipe. In other cases, the one or more of the logging tools 126 may communicate with a surface receiver 132 by wireless signal transmission. In at least some cases, one or more of the logging tools 126 may receive electrical power from a wire that extends to the surface, including wires extending through a wired drill pipe.

Figure 1B:
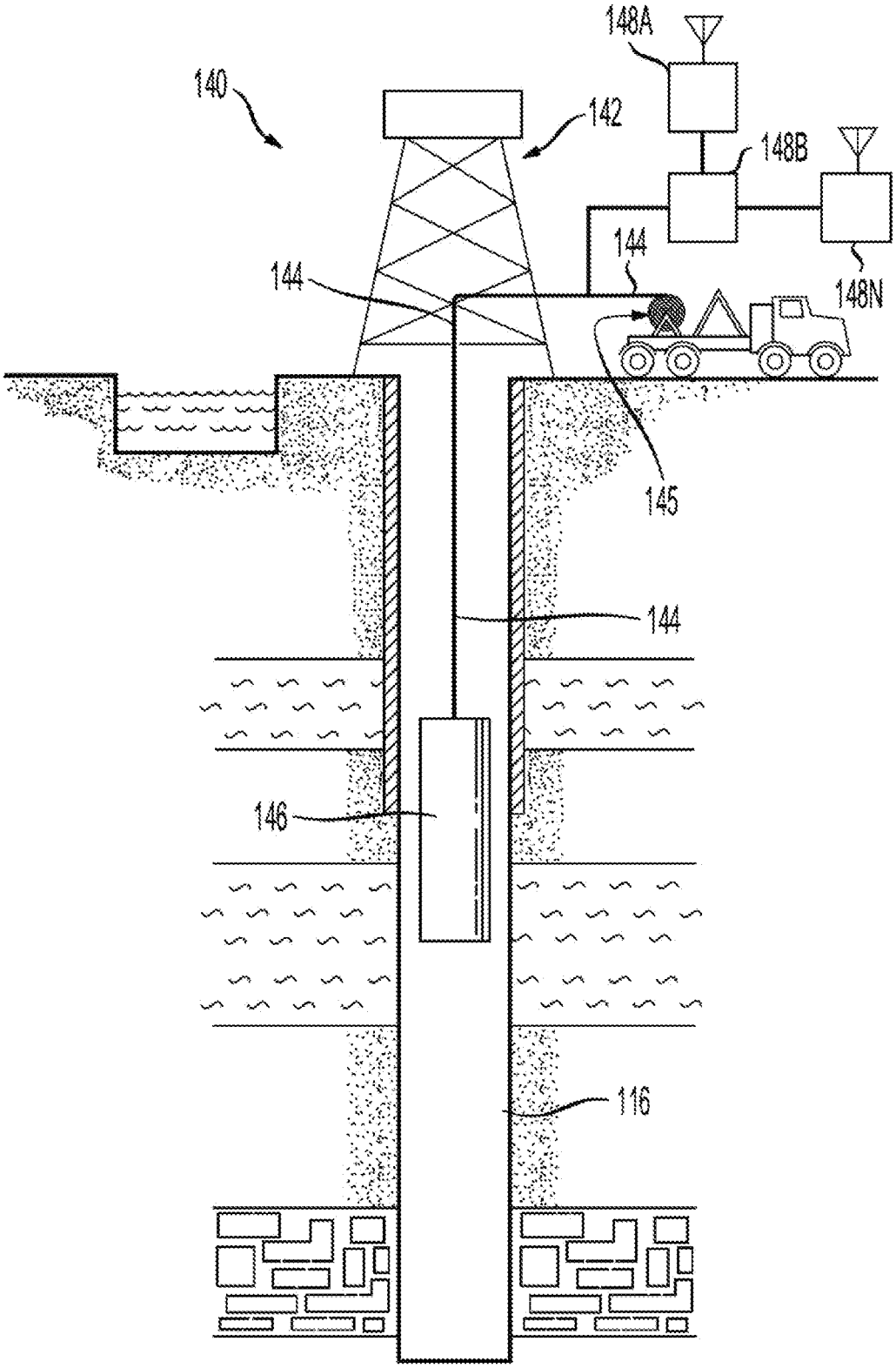
FIG. 1B is a schematic diagram of an example downhole environment having tubulars, in accordance with various aspects of the subject technology.

Referring to FIG. 1B, an example system 140 in a downhole environment can employ a tool having a tool body 146 in order to carry out logging and/or other operations. For example, instead of using the drill string 108 of FIG. 1A to lower tool body 146 of FIG. 2 and which can contain sensors and/or other instrumentation for detecting and logging nearby characteristics and conditions of the wellbore 116 and surrounding formation, a wireline conveyance 144 can be used. The tool body 146 can include a resistivity logging tool. The tool body 146 can be lowered into the wellbore 116 by wireline conveyance 144. The wireline conveyance 144 can be anchored in the drill rig 142 or by a portable means such as a truck 145. The wireline conveyance 144 can include one or more wires, slicklines, cables, and/or the like, as well as tubular conveyances such as coiled tubing, joint tubing, or other tubulars.

The illustrated wireline conveyance 144 provides power and support for the tool, as well as enabling communication between tool processors 148A-N on the surface. In some examples, the wireline conveyance 144 can include electrical and/or fiber optic cabling for carrying out communications. The wireline conveyance 144 is sufficiently strong and flexible to tether the tool body 146 through the wellbore 116, while also permitting communication through the wireline conveyance 144 to one or more processors 148A-N, which can include local and/or remote processors. Moreover, power can be supplied via the wireline conveyance 144 to meet power requirements of the tool. For slickline or coiled tubing configurations, power can be supplied downhole with a battery or via a downhole generator.

Figure 2:
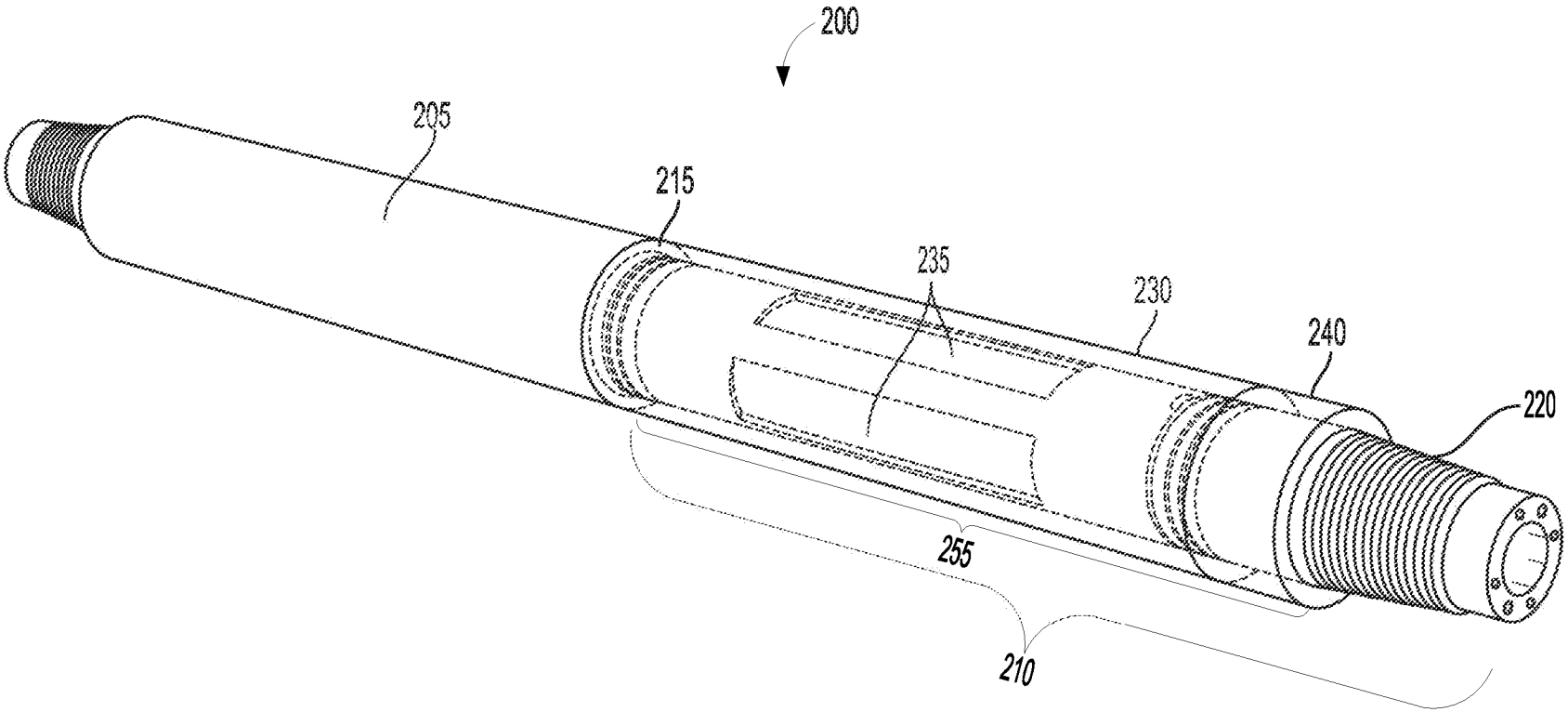
FIG. 2 is a diagram of a tool collar of a downhole tool, in accordance with various aspects of the subject technology.

FIG. 2 is a diagram of a tool collar 200 configured to carry one or more downhole components, in accordance with various aspects of the subject technology. The tool collar 200 may be a part of any downhole tool or tool body such as, for example, bottom-hole assembly 125 of FIG. 1A, the tool body 146 of FIG. 1B, or any other object lowered into a wellbore.

The tool collar 200 in FIG. 2 is shown including a recessed portion 210 and an unrecessed portion 205 where the recessed portion 210 has a smaller diameter than the unrecessed portion 205 of the downhole tool collar 200. The unrecessed portion 205 includes a shoulder 215 that marks the end of the unrecessed portion 205 and the beginning of the recessed portion 210.

The recessed portion 210 also includes a component segment 255 and a threaded segment 220. The component segment 255 is configured to hold one or more components (e.g., electrical components, sensors, etc.) of the downhole tool. For example, FIG. 2 shows the component segment 255 with pockets 235 configured to hold components, modules, or housings for components. The components may include, for example, electronics, sensors, power systems, and the like. The components may be held in place within the one or more pockets 235 of the recessed portion 210 of the downhole tool collar 200 by one or more end tabs, which may be shaped to conform to the shape of the pocket 235 so that when secured in place, the top portion of the end tab is substantially flush with the surface of the recessed portion 210 of the downhole tool collar 200. In other embodiments, other components, modules, or housings may be secured in place in the one or more pockets using other means (e.g., screws, fasteners, clamps, tight-fitting, etc.).

FIG. 2 further illustrates a rigid outer tubing such as a pressure sleeve 230 covering the component segment 255 of the tool collar 200 and any installed components. The pressure sleeve 230 may further secure the components in place within the pocket 235 of the recessed portion 210 of the downhole tool collar 200 as well as provide additional protection to the component modules. In some variations, the pressure sleeve 230 may be configured such that the pressure sleeve 230 provides additional strength and stability to the downhole tool collar 200. The pressure sleeve 230 may be made of a hard durable material such as aluminum, steel, or other types of metal, alloy, or rigid material.

Although not shown in FIG. 2, in some aspects, one or more additional layers may be disposed between the pressure sleeve 230 and the recessed portion 210 of the downhole tool collar 200 and any installed component assemblies. The additional layers may be, for example, a sleeve made of fiberglass that reduces the friction between the pressure sleeve 230 and the recessed portion 210 of the downhole tool collar 200 and any installed components. The additional layers may ease in the installation of the pressure sleeve 230 and/or improve the functionality of the downhole tool collar 200 in operation.

Various aspects of the subject technology provide several technological improvements over other approaches and solve various technical issues seen in other approaches. For example, as noted above, the pressure sleeve 230 or rigid outer tubing that covers the recessed portion 210 and components installed in the one or more pockets 235 provide additional protection. In contrast, other approaches may involve mounting a PCB assembly directly into the outer portion of the downhole tool collar 200 that is open to the downhole environment. In some cases, a hatch cover may protect the PCB assembly. However, the PCB assembly and/or the hatch cover in these approaches lack the protection and structural support of the pressure sleeve 230 or outer tubing of FIG. 2. The PCB assembly and/or the hatch cover approaches also provide an object to catch on objects or protrusions in the wellbore, which may damage the PCB assembly, housed components, and/or the downhole tool. Furthermore, with these other approaches, permanent damage often results from the aggressive procedures required to remove the electronic modules for maintenance or replacement.

The downhole tool collar 200 may also include one or more spacer rings 240 and/or torque sleeves covering the component segment 255 of the tool collar 200 or another area of the recessed portion 210 of the tool collar 200. In FIG. 2, a single spacer ring 240 is shown at one end of the pressure sleeve. However, in other configurations, one or more spacer rings or torque sleeves may be positioned at either end of the pressure sleeve. A threaded segment 220 of the recessed portion 210 is configured to allow a threaded component (not shown in FIG. 2 for clarity and illustrative purposes) to be mated to the threaded segment 220 and allow for the compression of the pressure sleeve 230 and the spacer ring 240 toward the shoulder 215 of the unrecessed portion 205 of the tool collar 200. The threaded segment 220, in some configurations, may be tapered. The threaded component is configured to compress any spacer rings 240, torque sleeves, and/or pressure sleeves 230 against the shoulder 215 of the unrecessed portion 205 of the downhole tool collar 200.

The pressure sleeve 230 is loaded in compression and the recessed portion 210 of the tool collar 200 is loaded in tension to enable the pressure sleeve 230, recessed portion 210 of the tool collar 200, and tool collar 200 to function as a unitary assembly. At one end, the pressure sleeve 230 abuts a shoulder 215 on the tool collar 200, and at the opposite end, the pressure sleeve 230 abuts a torque sleeve or spacer ring 240. Compression is generated by the threaded component (e.g., a threaded tool connection) acting against the torque sleeve or spacer ring 240, which acts against the pressure sleeve 230. At the abutting ends of the pressure sleeve 230, a predefined surface area is required to ensure that a sufficient amount of compressive forces are generated and maintained as the base collar is utilized in drilling operations and loaded with various bending moments. In addition, a predetermined thickness of the pressure sleeve is selected to obtain the desired section modulus and pressure rating for the assembly. Torque sleeve or spacer ring 240 is optional and can be keyed or not keyed with respect to the tool collar. The pressure sleeve 230 protects the component modules 225 which are positioned in the pockets 235 of the recessed portion 210 of the tool collar 200.

Figure 3:
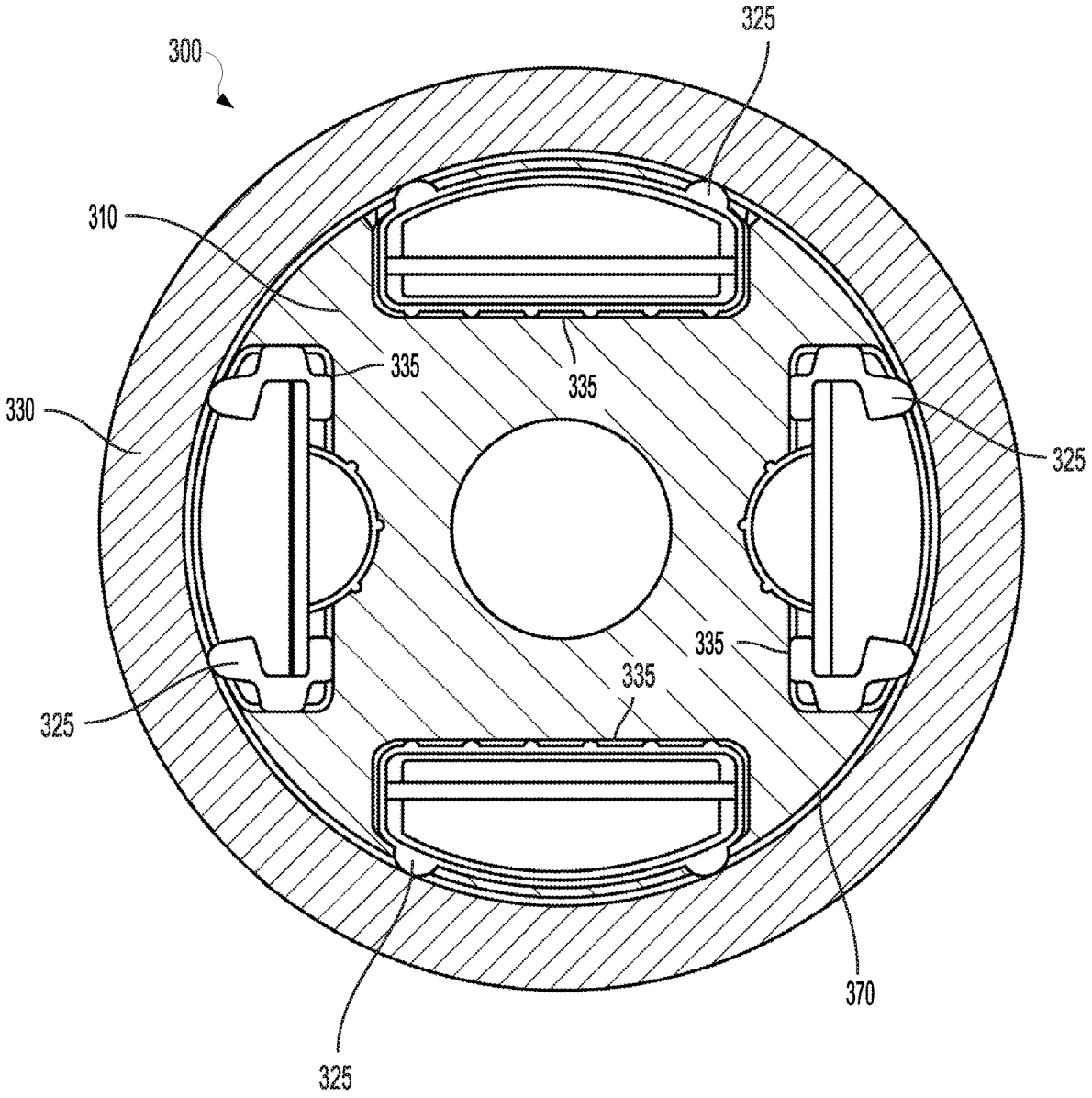
FIG. 3 is a schematic diagram of a cross section of a tool collar and sleeve of a downhole tool, in accordance with various aspects of the subject technology.

FIG. 3 is a schematic diagram of a cross-section of a tool collar 300, in accordance with various aspects of the subject technology. The cross-section illustrated in FIG. 3 is of a recessed portion 310 of the tool collar 300 that includes 4 pockets 335 located under the pressure sleeve 330. The recessed portion 310 includes component modules 325 disposed within the pockets 335. The component modules 325 may contain components used on the downhole tool collar. For example, the components may include electronic equipment, sensors, transmitters, receivers, batteries, power supplies, computing devices or components (e.g., processors, memory, etc.), or the like. An outer tubing or pressure sleeve 330 surrounds the recessed portion 310 of the downhole tool collar and the component modules 325 and protects the recessed portion 310 and the component modules 325 from the downhole environment.

According to some embodiments, one or more additional layers 370 may also be used to circumferentially surround at least a portion of the recessed portion 310 of the tool collar 300. Although only one layer 370 is shown in FIG. 3, more than one layer may be used. In some embodiments, the one or more layers may include a compliant sleeve that acts as a buffer between the recessed portion 310 and/or the component modules 325 and the pressure sleeve 330. The compliant sleeve can secure the recessed portion 310 of the tool collar 300 within an outer tubing or pressure sleeve 330 and provide an improved fit between the recessed portion 310 and the pressure sleeve 330. The compliant sleeve may be constructed, at least partially, from an elastomeric material such as plastic or rubber. The compliant sleeve may include a number of raised surfaces (e.g., ridges, ribs, bumps, or the like) on the exterior of the compliant sleeve that enable the improved fit and, in some cases, allow for improved expansion of the compliant sleeve in hot downhole environments. The raised surfaces may be made of the same material as the compliant sleeve or of a different material depending on desired characteristics. In some embodiments, the compliant sleeve may surround the component modules 325 in addition to or instead of the recessed portion 310 of the tool collar 300.

In some embodiments, the one or more layers may include an intermediate sleeve on the inside of the pressure sleeve 330, positioned between the pressure sleeve 330 and the recessed portion 310 of the tool collar 300 or the compliant sleeve, if present. The intermediate sleeve may be configured to reduce friction between the pressure sleeve 330 and the components that the intermediate sleeve surrounds (e.g., the recessed portion 310 of the tool collar 300 or the compliant sleeve) in order to facilitate placement of the pressure sleeve 330 over the recessed portion 310 of the tool collar 300. The intermediate sleeve can include a slit to allow the intermediate sleeve to have a more exact fit about the recessed portion 310 of the tool collar 300. The intermediate sleeve may be constructed from a fiber reinforced composite, such as a carbon fiber composite, aramid fiber composite, or fiber glass composite, and/or other material.

Figure 4:
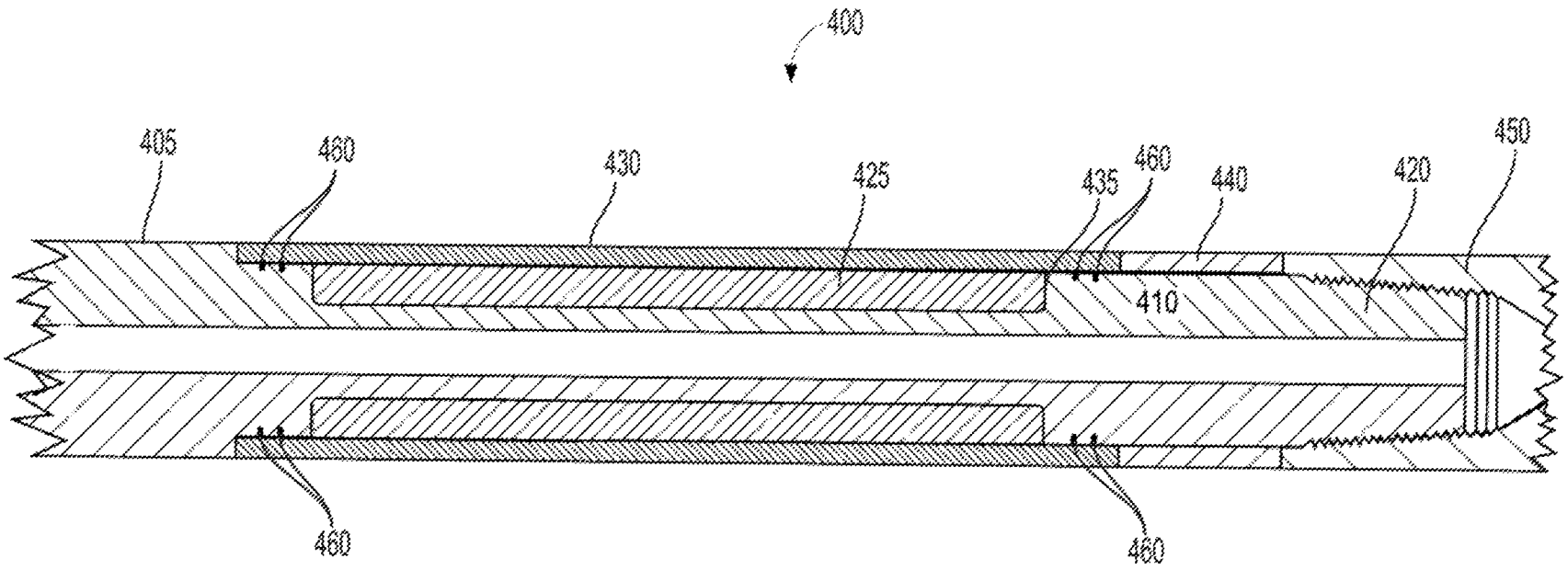
FIG. 4 is a diagram of a segment of a downhole tool that includes a tool collar and sleeve, in accordance with various aspects of the subject technology.

FIG. 4 is a diagram of a cross-section of a tool collar 400 that includes a component segment configured to carry one or more downhole components, in accordance with various aspects of the subject technology. The tool collar 400 may include a recessed portion 410 that includes component segment and a threaded segment 420. The component segment may include at least one pocket 435 configured to accept a downhole component module 425 such as electronics, sensors, printed circuit boards (PCBs), batteries, power supplies, etc. A pressure sleeve 430 circumferentially covers the recessed portion 410, including the at least a portion of one or more pockets 435 of the tool collar 400. A set of seals 460 or O-rings are positionable on opposite ends of the component segment, wherein the set of seals 460 or O-rings are further positionable between the pressure sleeve 430 and the recessed portion 410 of the tool collar 400. The pressure sleeve 430 may abut a shoulder of an unrecessed portion 405 of the tool collar 400.

The tool collar 400 may further include a spacer ring 440 or torque sleeve positionable between a threaded component 450 and the pressure sleeve 430. In some embodiments, one or more of the spacer rings 440 or torque sleeves may be placed at either or both ends of the pressure sleeve 430. The torque sleeve may include an anti-rotation mechanism configured to prevent rotation of the torque sleeve about the recessed portion. The anti-rotation mechanism may be, for example, a tab or key. The threaded component 450 (e.g., a threaded connection tool) may be mated to a tapered threaded segment 420 of the recessed portion 410 of the downhole tool and is configured to compress the spacer ring 440 (or torque sleeve) and the pressure sleeve 430 against the shoulder of the unrecessed portion 405 of the tool collar 400 or a shoulder of another component (e.g., a torque sleeve or spacer ring). In some embodiments, the threaded segment 420 of the recessed portion part may be straight and/or not tapered. In some embodiments, a spacer ring 440 and/or torque sleeve is not used and the threaded component 450 may directly compress the pressure sleeve 430 against the shoulder of the unrecessed portion 405.

Figure 5A:
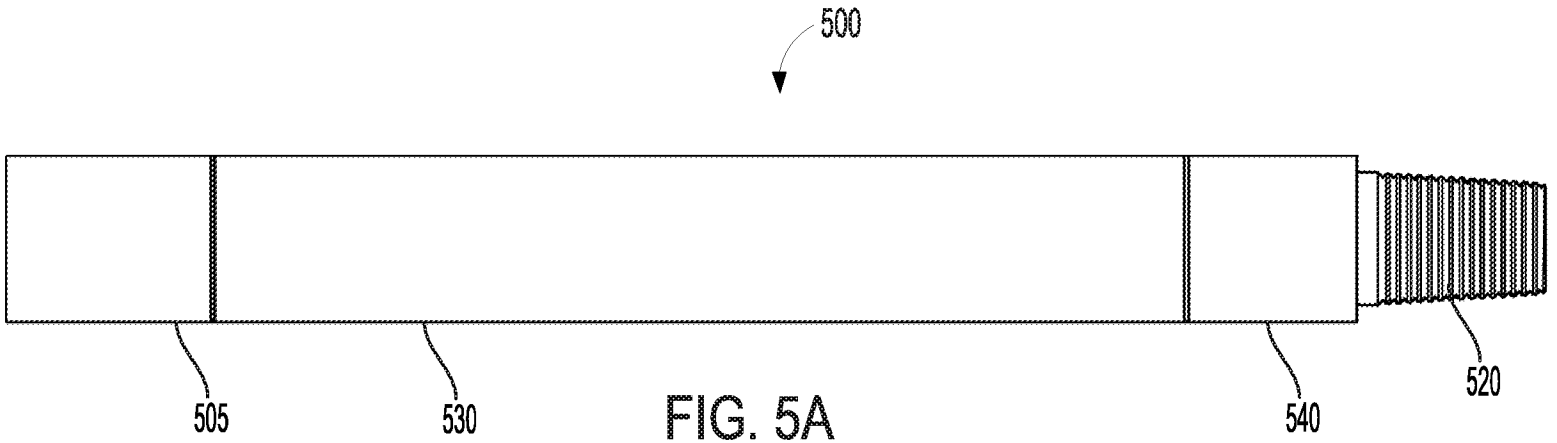
FIGS. 5A and 5B are diagrams of a tool collar of a downhole tool, in accordance with various aspects of the subject technology.
Figure 5B:
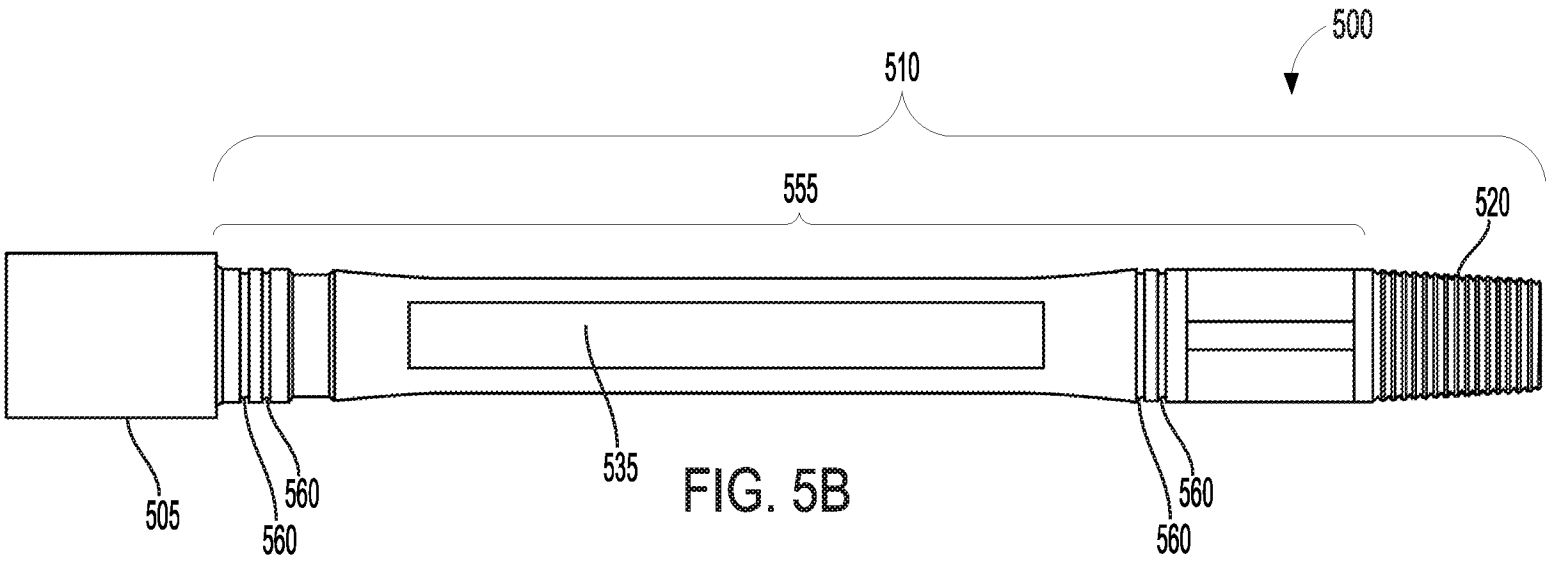

FIGS. 5A and 5B are diagrams of a tool collar, in accordance with various aspects of the subject technology. FIGS. 5A and 5B show the tool collar with the pressure sleeve 530 installed and removed. The tool collar may include a recessed portion 510 and an unrecessed portion 505 of the tool collar 500. The recessed portion 510 may include a component segment 555 and a threaded segment 520. The threaded segment 520 of the tool collar may be tapered. The recessed component segment 555 may further include at least one pocket 535 configured to accept a downhole component module.

A pressure sleeve 530 covers the recessed component segment 555. The tool collar may further include a torque sleeve 540 positionable between a threaded component (not shown in FIG. 5) and the pressure sleeve 530. The torque sleeve may include an anti-rotation mechanism configured to prevent rotation of the torque sleeve about the recessed portion 510 but still allow for compression by the threaded component. The tool collar may also include a set of O-rings or any seal positionable on opposite ends of the component segment, wherein the set of O-rings or other seal types are further positionable between the pressure sleeve and the recessed portion of the downhole tool. The recessed portion 510 may further include one or more channels 560 configured to accept the set of O-rings or other seal types and hold the seals in place. In regard to the seal channels 560, any type of seal can be incorporated. Sealing options are inclusive of but not limited to O-rings, T-seals, any cross-section elastomer seals, polytetrafluoroethylene (PTFE) seals, metal seals, etc.

Figure 6:
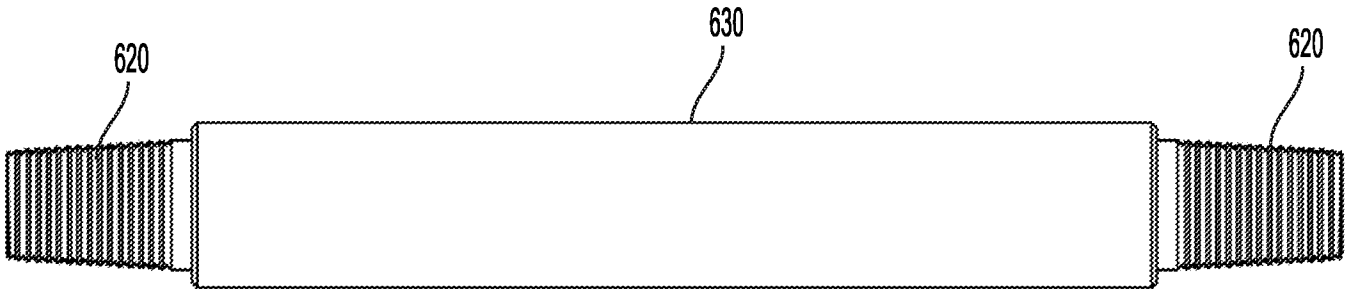
FIG. 6 is a diagram of a tool collar of a downhole tool, in accordance with various aspects of the subject technology.

Although some embodiments are described and illustrated with respect to compressing a pressure sleeve against a shoulder of an unrecessed portion of the tool collar, in other embodiments, various other parts of the tool collar (e.g., a spacer ring, a torque sleeve, a threaded component, or the like) may provide the shoulder against which the pressure sleeve is directly or indirectly compressed. For example, FIG. 6 is a diagram of a tool collar of a downhole tool, in accordance with various aspects of the subject technology. The tool collar is shown in FIG. 6 with a pressure sleeve 630 covering a recessed component segment that includes threaded segments 620 on both ends of the recessed component segment. Accordingly, two threaded components may be configured to mate with the threaded segments 620 on both ends of the recessed component segment and compress the pressure sleeve 630 and any included spacer rings or torque sleeves between the shoulders of the two threaded components.

Figure 7A:
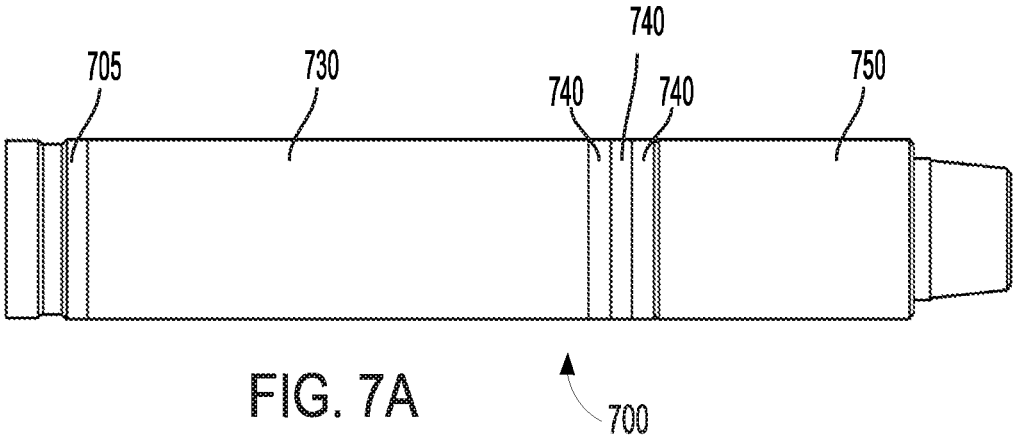
FIGS. 7A-7C are diagrams of example configurations of tool collars, in accordance with various aspects of the subject technology.
Figure 7B:
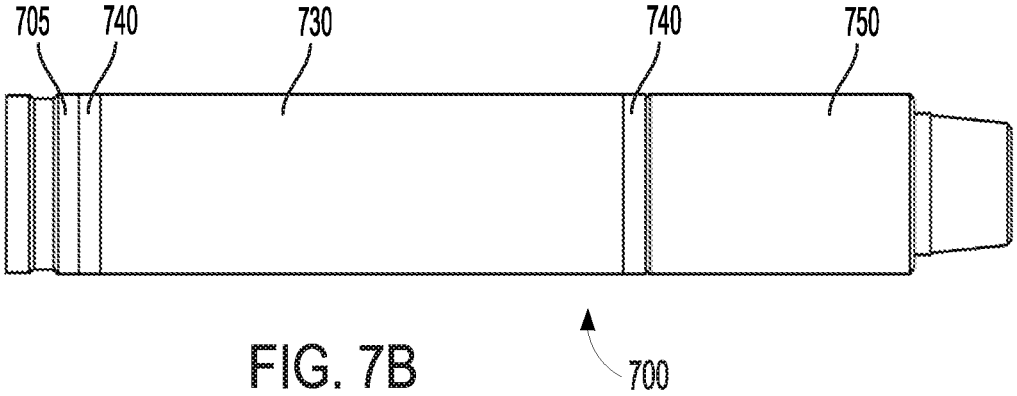
Figure 7C:
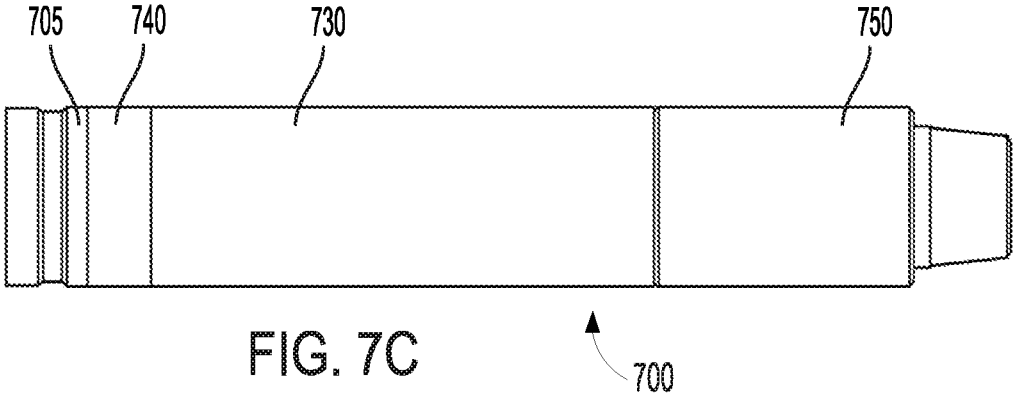

FIGS. 7A-7C are diagrams of example configurations of tool collars 700, in accordance with various aspects of the subject technology. Although spacer rings and/or torque sleeves are not used in every configuration, FIGS. 7A-7C show three different configurations that use spacer rings 740. In some embodiments, torque sleeves may be considered a type of spacer ring comprising an anti-rotation mechanism configured to prevent rotation of the spacer ring about the recessed portion. A torque sleeve may aid in the gripping, assembly, handling, and/or transport of a downhole tool.

In FIG. 7A, a tool collar 700 of a downhole tool is shown with an unrecessed portion 705 and a pressure sleeve 730 covering a recessed portion of the tool collar 700. The recessed portion may include a component segment and a threaded segment. The component segment may include at least one pocket configured to accept a downhole component (e.g., electronic components, sensors, or the like). The pressure sleeve 730 surrounds at least a portion of the recessed portion and abuts a shoulder of the unrecessed portion 705 of the tool collar 700 at one end. At the other end, the pressure sleeve 730 abuts a spacer ring 740. In some embodiments, as shown in FIG. 7A, multiple spacer rings 740 may be positioned together in a stacked formation. A threaded component 750 may be mated to the threaded segment and compress the one or more spacer rings 740 and the pressure sleeve 730 against the shoulder of the unrecessed portion 705.

FIG. 7B illustrates an example configuration where one or more spacer rings 740 and/or torque sleeves are placed on opposite ends of the pressure sleeve 730. Although FIG. 7B shows one spacer ring 740 on either end of the pressure sleeve 730, one or more spacer rings 740 may be positioned on each end.

FIG. 7C illustrates an example configuration where a spacer ring 740 is placed in between the shoulder of the unrecessed portion 705 of the tool collar 700 and the pressure sleeve 730. The pressure sleeve 730 abuts a spacer ring 740 at one end and the threaded component 750 at the other end. Although FIG. 7C shows one spacer ring 740 between the shoulder of the unrecessed portion 705 of the tool collar 700 and the pressure sleeve 730, a stacked set of spacer rings 740 may also be used in a configuration. Furthermore, the spacer rings 740 used on the tool collar 700 may be one or more sizes depending on use.

Figure 8:
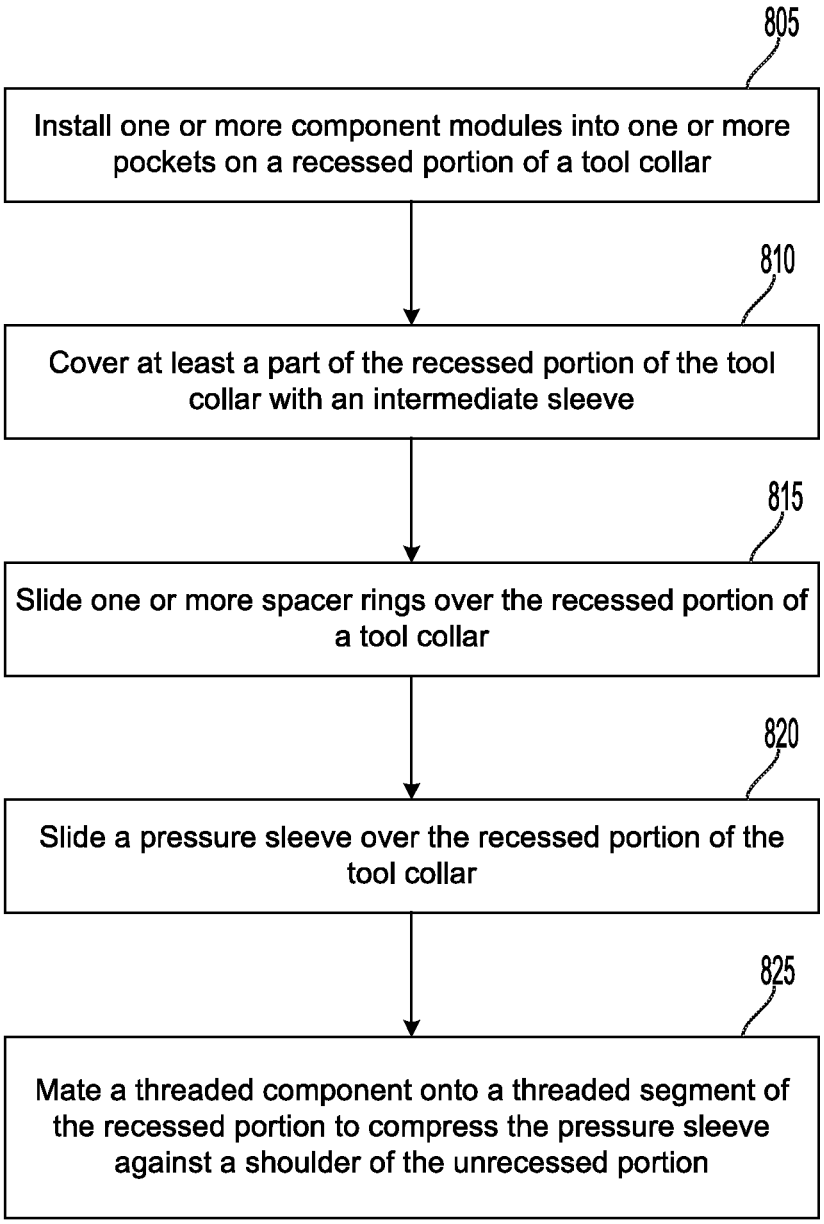
FIG. 8 is a flow diagram illustrating an example method for preparing a tool collar, in accordance with various aspects of the subject technology.

FIG. 8 is a flow diagram illustrating an example method for preparing a tool collar, in accordance with various aspects of the subject technology. The operations of the method presented below are intended to be illustrative. In some implementations, various embodiments may be accomplished with one or more additional operations not described and/or without one or more of the operations discussed. Additionally, the order in which the operations are illustrated in FIG. 8 and described below is not intended to be limiting and may be performed in different orders.

At operation 805, one or more component modules may be installed into one or more pockets on a recessed portion of a tool collar. For example, the component modules may be installed in the component segment of the recessed portion. At operation 810, an intermediate sleeve may be placed over the recessed portion of the tool collar to cover at least a part of the recessed portion. One or more spacer rings (or torque sleeves) may also be placed over the recessed portion of the tool collar at operation 815. At operation 820, a pressure sleeve may be placed over the recessed portion of the tool collar. At operation 825, a threaded component may be mated onto a threaded segment of the recessed portion of the tool collar to compress the pressure sleeve against a shoulder of the unrecessed portion.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general-purpose computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hard-wired links, wireless links, or by a combination thereof) through a communications network. In a distributed computing environment, program modules may be located in both local and remote memory storage devices.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrative embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the disclosure include:

Statement 1: A downhole tool comprising a recessed portion comprising a component segment and a threaded segment; an unrecessed portion comprising a shoulder; a pressure sleeve covering the recessed portion of the downhole tool; and a threaded component mated to the threaded segment and configured to compress the pressure sleeve toward the shoulder of the unrecessed portion.

Statement 2. The downhole tool of statement 2, further comprising a spacer ring positionable between the threaded component and the pressure sleeve.

Statement 3. The downhole tool of statements 1 or 2, further comprising a spacer ring positionable between the shoulder of the unrecessed portion and the pressure sleeve.

Statement 4. The downhole tool of statements 1 through 3, further comprising a torque sleeve positionable between the threaded component and the pressure sleeve, the torque sleeve comprising an anti-rotation mechanism configured to prevent rotation of the torque sleeve about the recessed portion.

Statement 5. The downhole tool of statements 1 through 4, wherein the recessed portion comprises a second threaded connection.

Statement 6. The downhole tool of statements 1 through 5, wherein the threaded segment is tapered.

Statement 7. The downhole tool of statements 1 through 6, wherein the recessed portion further comprises at least one pocket configured to accept a component module.

Statement 8. The downhole tool of statements 1 through 7, further comprising the component module, wherein the component module includes at least one of a printed circuit boards (PCB), a sensor, or a power system.

Statement 9. The downhole tool of statements 1 through 8, further comprising a set of O-rings positionable on opposite ends of the component segment, wherein the set of O-rings are further positionable between the pressure sleeve and the recessed portion of the downhole tool.

Statement 10. The downhole tool of statements 1 through 9, further comprising a sleeve that circumferentially surrounds at least a portion of the recessed portion.

Statement 11. A tool collar comprising a recessed portion comprising a component segment and a threaded segment; a pressure sleeve covering the recessed portion; and a threaded component mated to the threaded segment and configured to compress the pressure sleeve against a shoulder of the tool collar.

Statement 12. The tool collar of statement 11, further comprising a spacer ring positionable between the pressure sleeve and the shoulder of the tool collar.

Statement 13. The tool collar of statements 11 through 12, wherein the spacer ring is a torque sleeve comprising an anti-rotation mechanism configured to prevent rotation of the torque sleeve about the recessed portion.

Statement 14. The tool collar of statements 11 through 13, wherein the recessed portion comprises a second threaded connection.

Statement 15. The tool collar of statements 11 through 14, wherein the component segment further comprises at least one pocket configured to accept a downhole component module.

Statement 16. The tool collar of statements 11 through 15, wherein the threaded component compresses the pressure sleeve against the shoulder of the tool collar.

Statement 17. A method comprising sliding a pressure sleeve over a recessed portion of a tool collar, wherein the tool collar further comprises an unrecessed portion and mating a threaded component onto a threaded segment of the recessed portion of the tool collar to compress the pressure sleeve against a shoulder of the unrecessed portion of the tool collar.

Statement 18. The method of statement 7, further comprising covering at least a part of the recessed portion of the tool collar with an intermediate sleeve prior to sliding the pressure sleeve over the recessed portion of the tool collar.

Statement 19. The method of statements 17 through 18, further comprising installing one or more component modules into one or more pockets on the recessed portion.

Statement 20. The method of statements 17 through 19, further comprising sliding one or more spacer rings over the recessed portion of a tool collar.

Statement 21: A system comprising means for performing a method according to any of Statements 1 through 20.

What is claimed is:

1. A downhole tool comprising:

a tool collar with a recessed portion comprising a component segment and a threaded segment, wherein the recessed portion of the tool collar comprises at least one pocket directly located within the tool collar configured to accept a component module, wherein the entire component module is located within the pocket, the at least one pocket being positioned within the component segment of the recessed portion of the tool collar;

the tool collar with an unrecessed portion comprising a shoulder proximate to the recessed portion of the tool collar;

a pressure sleeve covering the recessed portion and the at least one pocket of the downhole tool, the pressure sleeve being positioned between the shoulder of the unrecessed portion of the tool collar and the threaded segment of the recessed portion of the tool collar, the pressure sleeve being removable to access the component module within the at least one pocket of the recessed portion of the tool collar;

a threaded component mated to the threaded segment and configured to compress the pressure sleeve toward the shoulder of the unrecessed portion of the tool collar;

a first spacer ring being positioned between the threaded component and the pressure sleeve, the first spacer ring being compressed toward the pressure sleeve by the threaded component to secure the pressure sleeve along the tool collar; and wherein the first spacer ring is a torque sleeve comprising an anti-rotation mechanism configured to prevent rotation of the torque sleeve about the recessed portion.

2. The downhole tool of claim 1, wherein a second spacer ring is positioned between the shoulder of the unrecessed portion and the pressure sleeve.

3. The downhole tool of claim 1, wherein the recessed portion comprises a second threaded connection.

4. The downhole tool of claim 1, wherein the threaded segment is tapered.

5. The downhole tool of claim 1, further comprising a set of O-rings positionable on opposite ends of the component segment.

6. The downhole tool of claim 5, wherein the set of O-rings are further positionable between the pressure sleeve and the recessed portion of the downhole tool.

7. The downhole tool of claim 1, further comprising wherein the component module includes at least one of a printed circuit boards (PCB), a sensor, or a power system.

8. The downhole tool of claim 1, further comprising the pressure sleeve circumferentially surrounds at least a portion of the recessed portion.

9. A tool collar comprising:

a recessed portion comprising a component segment and a threaded segment, wherein the recessed portion comprises at least one pocket configured to accept a downhole component module, wherein the entire component module is located within the pocket, the at least one pocket being positioned directly within the component segment of the recessed portion of the tool collar;

an unrecessed portion comprising a shoulder proximate to the recessed portion of the tool collar;

a pressure sleeve covering the recessed portion and the at least one pocket of the tool collar, the pressure sleeve being positioned between the shoulder of the unrecessed portion of the tool collar and the threaded segment of the recessed portion of the tool collar, the pressure sleeve being removable to access the downhole component module within the at least one pocket of the recessed portion of the tool collar;

a threaded component mated to the threaded segment and configured to compress the pressure sleeve against the shoulder of the unrecessed portion of the tool collar;

a spacer ring being positioned between the pressure sleeve and the shoulder of the unrecessed portion of the tool collar; and wherein the spacer ring is a torque sleeve comprising an anti-rotation mechanism configured to prevent rotation of the torque sleeve about the recessed portion.

10. The tool collar of claim 9, further comprising a set of O-rings positionable on opposite ends of the component segment.

11. The tool collar of claim 9, wherein the recessed portion comprises a second threaded connection.

12. The tool collar of claim 9, wherein the threaded segment is tapered.

13. The tool collar of claim 9, wherein the threaded component compresses the pressure sleeve against the shoulder of the tool collar.

14. A method comprising:

providing a tool collar comprising:

a recessed portion comprising a component segment and a threaded segment, wherein the recessed portion comprises one or more pockets configured to accept one or more component modules, wherein the entire structure of each of the one or more component modules is located within the one or more pockets, the one or more pockets being directly positioned within the component segment of the recessed portion of the tool collar;

an unrecessed portion comprising a shoulder proximate to the recessed portion of the tool collar;

a pressure sleeve covering the recessed portion and the one or more pockets of the tool collar, the pressure sleeve being positioned between the shoulder of the unrecessed portion of the tool collar and the threaded segment of the recessed portion of the tool collar, the pressure sleeve being removable to access the one or more component modules within the one or more pockets of the recessed portion of the tool collar; a threaded component mated to the threaded segment and configured to compress the pressure sleeve against the shoulder of the unrecessed portion of the tool collar; and one or more spacer rings being positioned between the threaded component and the pressure sleeve, the one or more spacer rings being compressed toward the pressure sleeve by the threaded component to secure the pressure sleeve along the tool collar;

sliding the pressure sleeve over the recessed portion of the tool collar;

mating the threaded component onto the threaded segment of the recessed portion of the tool collar to compress the pressure sleeve against the shoulder of the unrecessed portion of the tool collar;

installing the one or more component modules into the one or more pockets on the recessed portion of the tool collar;

sliding the one or more spacer rings over the recessed portion of the tool collar; and wherein the one or more spacer rings is a torque sleeve comprising an anti-rotation mechanism configured to prevent rotation of the torque sleeve about the recessed portion.

15. The method of claim 14, further comprising covering at least a part of the recessed portion of the tool collar with an intermediate sleeve prior to sliding the pressure sleeve over the recessed portion of the tool collar.

16. The method of claim 14, wherein the one or more component modules includes at least one of a printed circuit boards (PCB), a sensor, or a power system.

* * * * *